United States Patent [19]

Wells et al.

[11] Patent Number: 4,771,995

[45] Date of Patent: Sep. 20, 1988

[54] COLLAPSIBLE BOX SPRING

[75] Inventors: Thomas J. Wells, Carthage, Mo.; Angelo Serafini, East Boston, Mass.

[73] Assignee: Leggett & Platt, Incorporated, Carthage, Mo.

[21] Appl. No.: 38,502

[22] Filed: Apr. 15, 1987

[51] Int. Cl.[4] ..... F16F 3/00; A47C 23/08; A47C 23/02; C21B 7/00

[52] U.S. Cl. ..... 267/103; 5/240; 5/250; 5/247; 267/142

[58] Field of Search ..... 5/247, 249, 240, 250, 5/255, 476; 267/103, 104, 105, 182, 142, 158, 160; 140/2, 3 CA, 102; 29/34 D, DIG. 3; 220/7, 19

[56] References Cited

U.S. PATENT DOCUMENTS

| | | | |
|---|---|---|---|
| 210,148 | 11/1878 | Richardson | 5/112 |
| 332,081 | 12/1885 | Jeffery et al. | 5/249 |
| 639,628 | 12/1899 | Thomsen et al. | 220/7 |
| 908,524 | 1/1909 | Vincent | 5/250 |
| 927,982 | 7/1909 | Klippel | 5/249 |
| 940,234 | 11/1909 | Burleson | 220/7 |
| 982,093 | 1/1911 | Russ | 108/121 |
| 1,052,706 | 2/1913 | Zingg | 5/247 |
| 1,215,292 | 2/1917 | McKay | 220/7 |
| 1,286,607 | 12/1918 | Hammrich | 5/247 |
| 1,528,125 | 3/1925 | Morse | 5/247 |
| 1,918,003 | 7/1933 | Taylor et al. | 108/56.1 |
| 2,430,267 | 11/1947 | Arthur | 108/56.1 |
| 2,462,539 | 2/1949 | Neely et al. | 5/247 X |
| 2,542,904 | 2/1951 | Cobb | 5/247 X |
| 2,634,427 | 4/1953 | Wodarsky | 5/13 |
| 2,773,270 | 12/1956 | Rozelle | 5/247 |
| 2,832,497 | 4/1958 | Shroyer | 248/346 X |
| 2,974,326 | 3/1961 | Ross | 5/255 |
| 3,085,259 | 4/1963 | Sandor | 5/247 |
| 3,546,723 | 12/1970 | Ciampa et al. | 5/247 |
| 3,892,001 | 7/1975 | Schneider | 5/478 |
| 4,003,564 | 1/1977 | Taylor | 5/247 X |
| 4,050,738 | 9/1977 | Griffiths | 267/103 X |
| 4,069,525 | 1/1978 | Valoff | 267/105 X |
| 4,120,058 | 10/1978 | Kitchen et al. | 5/247 |
| 4,377,279 | 3/1983 | Schulz, Jr. et al. | 267/103 |
| 4,555,097 | 11/1985 | Hiatt | 5/247 X |
| 4,639,957 | 2/1987 | Wells et al. | 5/248 |

FOREIGN PATENT DOCUMENTS

| | | | |
|---|---|---|---|
| 2204020 | 8/1973 | Fed. Rep. of Germany | 267/103 |
| 614133 | 7/1947 | United Kingdom | 267/107 |

*Primary Examiner*—Andres Kashnikow
*Assistant Examiner*—Robert J. Oberleitner
*Attorney, Agent, or Firm*—Wood, Herron & Evans

[57] ABSTRACT

A collapsible bedding foundation comprises a rectangular base frame and a rectangular wire grid. The wire grid is hingedly supported upon the frame for movement between a collapsed position and an erect position. The hinged connection between the wire grid and the base frame is achieved by a plurality of transverse spaced, parallel planar support elements pivotally connected to the base frame and the wire grid. The foundation is supported in an erect position solely by a pair of longitudinally extending, parallel planar support elements pivotally connected to the longitudinal edge of the wire grid and, when the foundation is erect, fixedly secured to the base frame.

13 Claims, 2 Drawing Sheets

COLLAPSIBLE BOX SPRING

This invention relates to bedding products, and more particularly to bedding foundation products. Bedding foundations are used to support bedding mattresses, and quite commonly provide resilient support for the bedding mattress.

Traditionally, bedding foundations comprise multiple coil springs mounted upon a wooden base frame and overlaid by a top connector, such as a wire grid, which interconnects the top turns or revolutions of the coil springs. This combination of base frame, coil springs and top connector is generally overlaid by padding and encased within an upholstered covering, which covering generally stretches over the top of the padding and around the sides of the foundation to be tacked to the underside of the wooden frame.

There have been many departures from this traditional coil spring type of bedding foundation. Many of these departures utilize formed wire springs in place of the more traditional coil springs. Examples of such formed wire spring bedding foundations may be found in the U.S. Pat. No. 4,555,097, issued Nov. 26, 1985 to Hiatt, and U.S. Pat. No. 4,639,957, issued Feb. 3, 1987 to Wells, et al.

Quite commonly, the wooden base frame, springs and top connector of a foundation are preassembled into a foundation subassembly by one manufacturer and shipped to a bedding company, which bedding company then applies the padding and upholstery to the foundation unit in preparation for its ultimate sale to a customer. The shipment of the subassembly is a substantial portion of the total cost of the foundation to the bedding manufacturer. In an effort to reduce that shipping cost, the springs of the foundation may be compressed during shipment in order to permit a greater number of foundations to be shipped in a single container. Because bedding foundation springs, though, do not generally lend themselves to compression for shipment, the components of the subassembly are quite commonly shipped to the bedding manufacturer, who in turn assembles them at his place of business. Thereby, shipment costs are minimized, but the bedding manufacturer is thus required to assemble the subassembly.

In an effort to reduce shipping costs of a bedding foundation subassembly, there is disclosed in U.S. Pat. No. 4,377,278 a collapsible bedding foundation. According to the disclosure of this patent, a bedding foundation comprising a wooden base frame and a top wire grid are interconnected by several spaced rows of flat support members which are hingedly secured to the top grid and to the bottom frame so as to permit the top structure to be pivoted downwardly on the support members into close adjacency with the wooden base frame. Before the foundation is upholstered, the flat support members are placed in a vertical position, thereby raising the wire grid to a position spaced from the base frame by the height of the support members. In order to maintain the collapsible foundation in a raised or erect position, the foundation includes stabilizing struts pivotally attached to the top grid and extending downwardly at an angle into contact and securement to the base frame. The angled struts connected at the top to the wire grid and at the bottom to the base frame extend inwardly from opposite sides of the top grid to which the struts are pivotally attached and thereby prevent the erected foundation from pivoting back into a collapsed condition about the pivotable support members.

It has been an objective of this invention to provide a collapsible box spring, but one which does not require opposed diagonal struts extending between the top grid and the bottom frame to maintain the foundation in an erect position.

Still another objective of this invention has been to provide an improved collapsible bedding foundation which is less expensive and less costly to manufacture than collapsible foundations of the type described hereinabove.

The collapsible foundation made in accordance with the invention of this application comprises a rectangular base frame and a rectangular top wire grid movable between a first collapsed condition, in which the wire grid resides in close adjacency to the base frame, and a second erect condition, in which the wire grid is spaced above the base frame. The wire grid is supported from the base frame by a plurality of parallel, spaced planar support elements which extend laterally between opposite sides of the base frame and wire grid, the support elements being pivotally secured at the bottom to the base frame and at the top to the wire grid. According to the practice of this invention, the foundation is maintained in an erect condition by a pair of planar wire support elements which extend between the longitudinal side edges of the frame and wire grid and are pivotally secured to one of the base frame and wire grid when the foundation is in a collapsed condition. When the foundation is in a raised condition, the pair of planar wire support elements on the longitudinal sides of the foundation are fixedly secured to the other of the base frame and wire grid, in which condition of the foundation the second pair of planar support elements are located in a vertical plane.

The advantage of this invention over prior collapsible foundations is that the side edge support elements which maintain the foundation in an erect condition function also as side edge supports of the foundation. In other words, these side edge support elements serve the dual function of maintaining the foundation in an erect condition and of adding edge support to the side edges of the foundation.

In the preferred embodiment of the invention, each of the planar support elements is manufactured from a unitary wire so configured as to lend vertical resiliency to the unit. This preferred construction of planar support elements is characteristic of both the lateral support elements and of the longitudinal support elements which maintain the foundation in an erect condition.

Other objects and advantages of this invention will be more readily apparent from the following description of the drawings in which.

Figure 1:
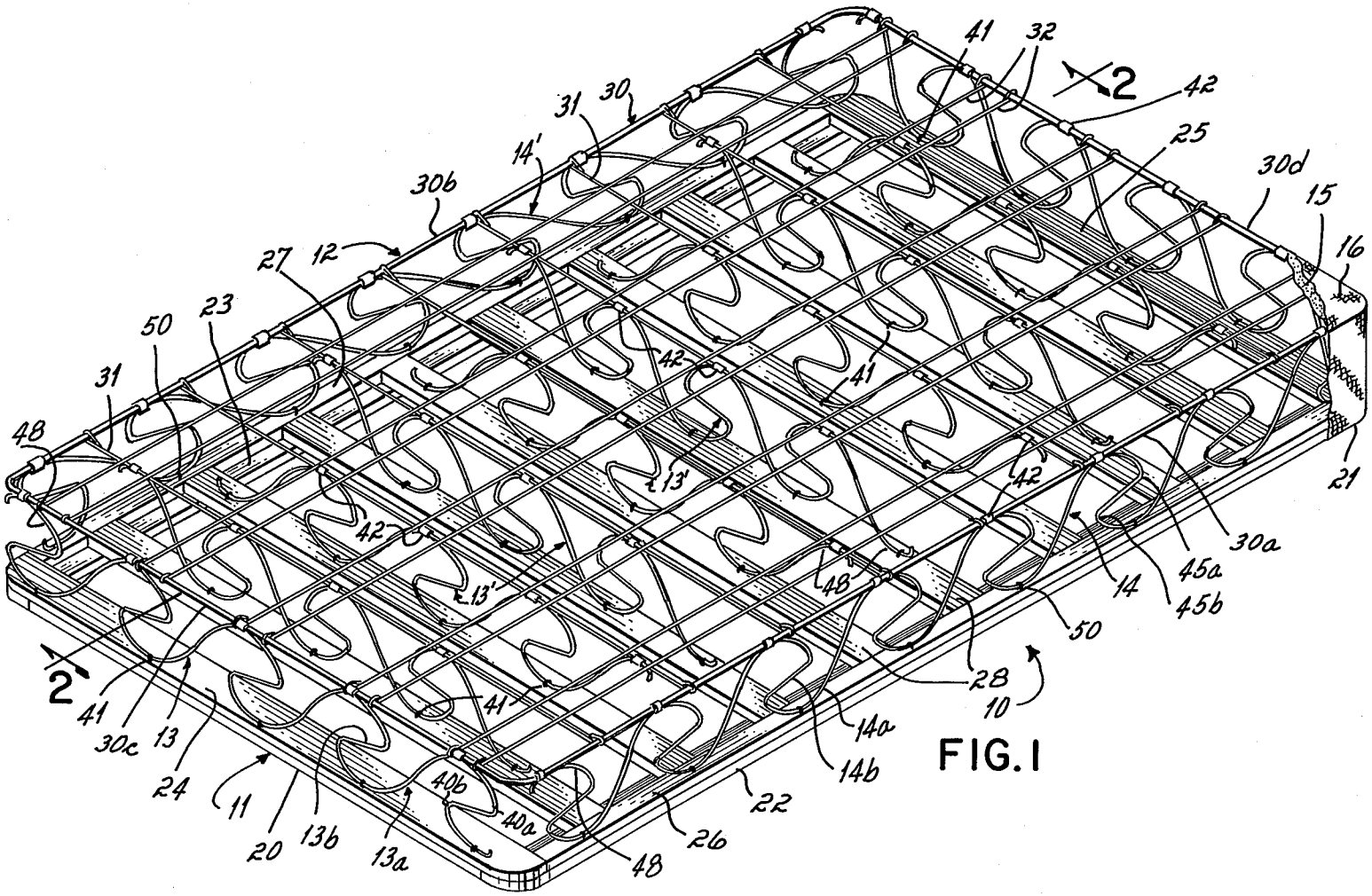
FIG. 1 is a perspective view of a bedding foundation incorporating the invention of this application.

With reference first to FIG. 1, there is illustrated a bedding foundation 10 incorporating the invention of this application. This foundation 10 comprises a wooden base frame 11 and a top wire grid 12 interconnected by transverse planar supporting elements 13. In the erect condition of the foundation 10, the planar supporting elements 13 are located in vertical planes, while the wooden base frame and top wire grid are located in spaced horizontal planes separated by the vertical height of the supporting elements 13. Padding 15 overlies the top wire grid 12, and upholstered covering 16 extends over the top of the foundation and over the side walls and is tacked to the underside of the wooden base frame.

The foundation 10 is so constructed that the wooden base frame 11, supporting elements 13, and top wire grid 12 may be preassembled and shipped to a bedding manufacturer in a collapsed position in which the top wire grid is located in a horizontal plane in close adjacency to the horizontal plane of the wooden base frame 11. To facilitate collapse of the subassembly of base frame supporting elements and top wire grid 12 into this collapsed condition, illustrated in solid lines in FIG. 2, each of the supporting elements 13 is pivotally connected at the top to the top wire grid and at the bottom to the foundation 10. This pivotable or hinged connection of the supporting elements to the frame and wire grid enables the supporting elements to be pivoted between the horizontal position illustrated in FIG. 2 and the upright or vertical position illustrated in FIG. 1.

The wooden base frame 11 comprises a pair of end boards 20, 21 and a pair of side boards 22, 23. Mounted atop each of the end boards 20, 21 there is a supporting platform board 24, 25, respectively. Similarly, mounted atop each of the side boards 22, 23 there is a supporting platform board 26, 27. The platform boards 26, 27 are of less width than the side boards 22 so that a portion of the top surface of the side boards 22, 23 on the inside of the top platform boards 26, 27 is exposed and available for supporting transverse wooden slats 28. These slats 28 extend transversely between the side platform boards 26, 27 and are supported from the side boards 22, 23, upon the tops of which the slats rest. The wooden base frame 11 comprising these end boards, side boards and platform boards are all glued or nailed together to form a subassembly in which the top surfaces of the end platform boards, side platform boards, and slats are all located in a common horizontal plane.

The top wire grid 12 comprises a rectangular border wire 30, as well as a plurality of transverse grid wires 31 and longitudinal grid wires 32. The transverse grid wires 31 extend between opposite sides **30*a*, 30*b* of the rectangular border wire and at the ends are wrapped around the border wire. Preferably, the ends of the transverse grid wires 31 are fixedly secured to the border wire as by welding. Similarly, the longitudinal grid wires 32 extend between opposite ends 30*c*, 30*d* of the border wire. The ends of the longitudinal grid wires are also fixedly secured to the ends of the border wire as by welding. Preferably, the intersections of the longitudinal grid wires 32 and the transverse border wires 31 are welded so as to prevent relative movement between the grid wires and any noise which might result therefrom. Additionally, welding of these intersections enhances the stability of the foundation 10**.

Figure 3:
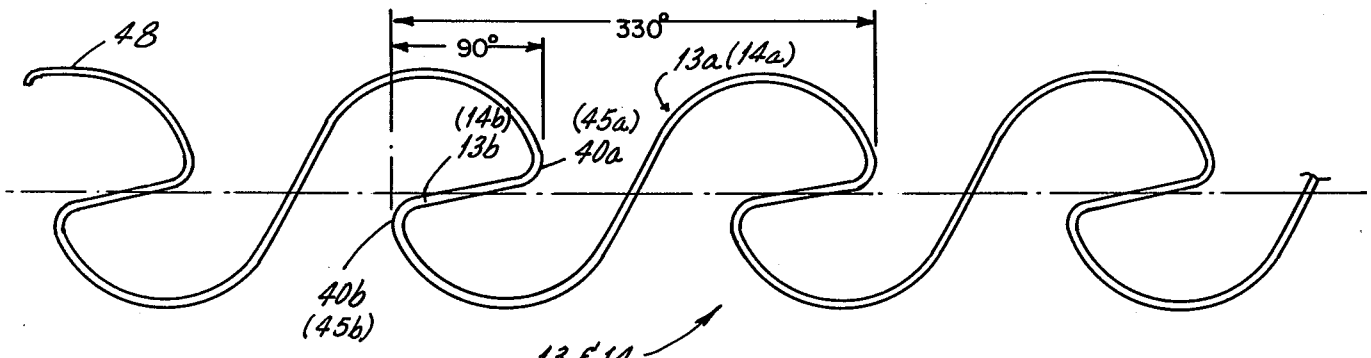
FIG. 3 is a side elevational view of one of the hinged supporting elements of the foundation of FIG. 1.

With reference to FIGS. 1 and 3, it will be seen that each of the transverse support elements comprises a unitary wire having several sinusoidal sections **13*a* interconnected by offset sections 13*b*. Each sinusoidal section 13*a* extends through approximately 330° of a sinusoidal curve and is overlapped relative to an adjacent sinusoidal curved section 13*a* by approximately 90° of a sinusoidal curve. Adjacent ends 40*a*, 40*b* of overlapped sinusoidal sections are interconnected by the offset sections 13*b*. All of the sections 13*a*, 13*b* of a single unitary transverse support element 13 are located in a common plane, that plane being vertical when the foundation is erect or very nearly horizontal when the foundation is collapsed. The sinusoidal sections of the transverse support elements 13 are pivotally connected at the bottom to the wooden frame by conventional staples 41 and at the top to either the end sections 30*c*, 30*d* of the border wire or to the transverse wires 31 of the grid by conventional sheet metal clips 42**.

Figure 2:
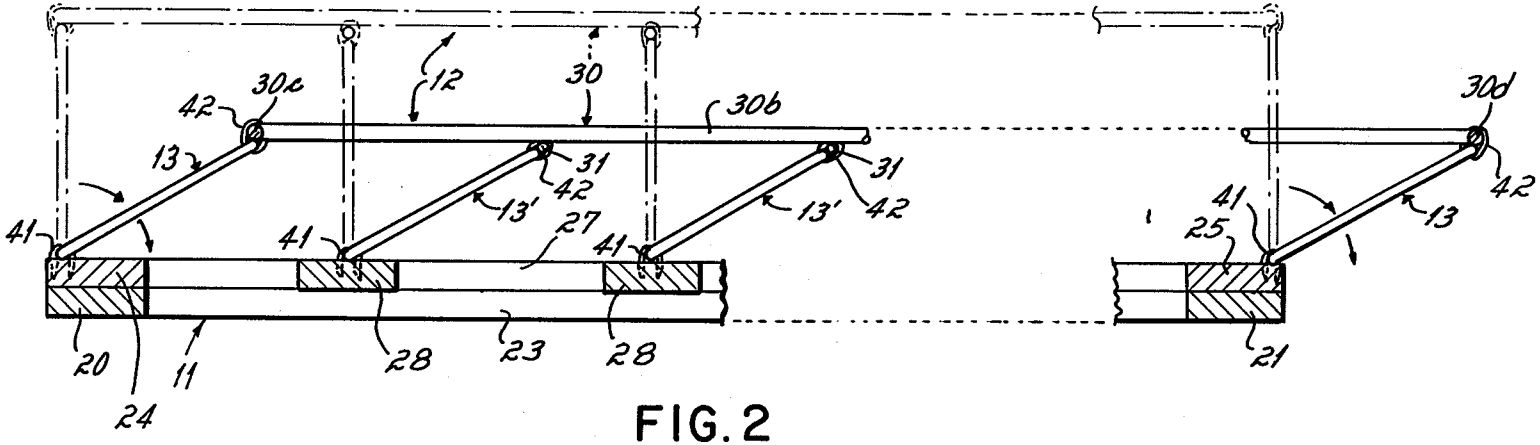
FIG. 2 is a fragmentary cross-sectional view taken on line 2—2 of FIG. 1 illustrating the foundation in solid lines in a partially collapsed condition and in phantom lines in an erect condition.

The longitudinal supporting elements 14 are configured substantially identically to the transverse supporting elements 13, except that the longitudinal elements 14 are of greater length from end to end than are the transverse supporting elements. This added length accommodates the length of the foundation which is substantially longer than it is wide. Specifically, each longitudinal supporting element 14 comprises sinusoidal shaped sections **14*a* and offset interconnecting sections 14*b*. The sinusoidal sections extend over approximately 330° of a 360° sinusoidal curve. The sinusoidal curved sections 14*a* are overlapped, and the ends 45*a* of the overlapped sinusoidal sections are interconnected by the straight offset sections 14*b*. The longitudinal supporting elements 14 are pivotally or hingedly connected to the sides 30*a*, 30*b* of the border wire 30 by conventional metal clips 42. When the foundation subassembly comprising the base frame 11, top wire grid 12, and supporting elements 13 and 14 is collapsed, as illustrated in FIG. 2, the longitudinal supporting elements are folded inwardly about the hinged clip connections 42 so as to position the longitudinal supporting elements between the top wire grid 12 and the base frame 11. The longitudinal supporting elements 14, though, could be folded or hinged outwardly and over the top of the top wire grid 12, rather than being positioned between the grid and the frame. In either collapsed position of the longitudinal supporting elements 14**, the collapsed foundation subassembly requires little more storage space one way or the other.

When the subassembly is erected by the bedding manufacturer after shipment or storage and in preparation for completion of the manufacture of the foundation, the top wire grid 12 is lifted upwardly away from the horizontal plane of the base frame 11. This movement is accommodated by the hinged connections between the transverse supporting elements 13 and the grid, as well as between the supporting elements 13 and the base frame. When the foundation is fully erected, the transverse supporting elements are located in spaced vertical planes relative to the base frame and top wire grid, which are then located in spaced horizontal planes. With the transverse supporting elements 13 located in vertical planes, the longitudinal supporting elements 14 may be pivoted into vertical planes and then fixedly attached to the side platform 26, 27 of the base frame. This last attachment is usually accomplished by staples 50 which secure the bottoms of the longitudinal supporting elements to the base frame. With the longitudinal supporting elements fixedly secured to the base frame and the top wire grid 12, the erected foundation subassembly is precluded against collapse or partial collapse by the longitudinal supporting elements 14. Specifically, those elements 14 prevent the top wire grid from moving longitudinally relative to the base frame, and the transverse supporting elements 13 prevent the top wire grid from moving laterally relative to the base frame. Consequently, the erect foundation 10, which is maintained in the erect position solely by the longitudinal supporting elements 14, is not prone to collapse or to any movement of the top wire grid 12 relative to the base frame 11. This lateral and longitudinal stability of the top wire grid 12 relative to the base frame is enhanced by the metal clips 42 being secured to arcuate sections of the supporting elements 13 and 14. Thereby, relative sliding movement between the supporting elements and the wire grid, or between the supporting elements and the base frame, is precluded.

With reference particularly to FIG. 1, it will be seen that the endmost transverse supporting elements 13 are longer from end to end than the intermediate transverse supporting elements 13. In the illustrated embodiment, the endmost supporting element 13 comprises four sinusoidal arcuate sections 13*a*, as well as five offset sections 13*b*. Additionally, the endmost transverse elements 13 terminate in short arcuate sections 48 which are pivotally secured at one end of the element 13 to the base frame 11, and at the opposite end to the border wire 30.

The transverse supporting elements 13' located inwardly from the endmost supporting elements 13 are all identical. Each comprises four sinusoidal sections 13*a* interconnected by three straight offset sections 13*b*. Each supporting element 13' is hingedly connected to a transverse slat 28 by staples 41 and to a transverse wire 31 of the top wire grid 12 by sheet metal clips 42. It is to be noted that the sheet metal clips 42 which interconnect the transverse supporting elements 13 to the transverse wires 31 of the wire grid are all longitudinally aligned with other longitudinal clips which interconnect the adjacent transverse supporting element to the wire grid. The staples 41, though, which connect the transverse supporting element 13 to the transverse slats 28 are all laterally offset relative to the staples which connect the adjacent transverse supporting elements 13 to the adjacent slats 28. This offsetting relationship is achieved by vertically inverting each transverse supporting element 13 relative to the next adjacent supporting element 13'. The configuration of the supporting elements 13, and particularly the length of the offsets 13*b*, is selected such that each staple 41 which connects the supporting element 13 to the transverse slat 28 is located transversely in a position approximately medially of the staples which interconnected the adjacent supporting element 13 to the adjacent supporting slat 28. The advantage of this offsetting relationship is that it more evenly distributes the vertical loading of the top wire grid to the wooden base frame via the transverse supporting elements 13.

Again, with reference to FIG. 1 it will be noted that the same inverted relationship exists between the longitudinal supporting element 14 on one side of the foundation, and the longitudinal supporting element 14' on the other side of the foundation. As a consequence of this relationship, the staples 50 on one side of the frame which interconnect the longitudinal supporting element to the base frame are longitudinally offset relative to the staples which connect the supporting element 14 to the base frame 11 on the opposite side of the frame. This inversion of the longitudinal supporting elements 14, 14' relative to one another also results in a more even transfer of weights or loads from the top wire grid to the base frame.

In order to construct or assemble the foundation 10 illustrated in FIG. 1, the wooden base frame 11 is first constructed as a subassembly unit. The transverse supporting elements 13 are then stapled to the base frame 11. The top wire grid 12 is then placed as a complete subassembly item onto the top of the assembled base frame 11 and transverse supporting elements 13 and is secured to the transverse supporting elements by the sheet metal clips 42. In the preferred embodiment, the longitudinal supporting elements 14 are then secured by the sheet metal clips to the border wire 30. Thus assembled, the top wire grid is pivoted about the transverse supporting elements into the collapsed position illustrated in FIG. 2 wherein the longitudinal supporting elements are pivoted about the hinged connections to the border wire into a position in which those longitudinal supporting elements are either located between the top wire grid and the base frame or overlie the top of the top wire grid 12. In this collapsed condition of the subassembly, the foundation may be shipped to a bedding manufacturer or may be stored in the collapsed condition. When the bedding manufacturer is ready to complete the unit, the top wire grid is pivoted about the transverse supporting elements 13 into a position in which the transverse supporting elements are located in parallel, spaced vertical planes perpendicular to the horizontal planes of the base frame 11 and top wire grid 12. The longitudinal supporting elements 14, 14' are then pivoted into vertical planes perpendicular to the vertical planes of the transverse supporting elements and are secured to the base frame by the staples 50. Thereafter, the padding 15 is placed atop the wire grid, and the complete assembly, including the padding, is encased within an upholstered covering 16 which overlies the top wire grid, as well as the sides of the unit, and is tacked or otherwise secured to the underside of the frame 11.

While I have described only a single preferred embodiment of a box spring incorporating the invention of this application, it will be appreciated that numerous other configurations of box springs incorporating the invention of this application will be appreciated by persons skilled in this art. Specifically, such persons will appreciate that other and differing configurations of transverse and longitudinal supporting elements may be substituted for the transverse supporting elements 13 and longitudinal supporting elements 14 disclosed in this application. Several such variations are disclosed and described in the above-identified U.S. Pat. No. 4,377,279. Furthermore, the transverse supporting elements 13 could be connected to the transverse wires of the wire grid by connectors other than the sheet metal clips 42. For example, hooks, such as the hooks disclosed in Ciampa U.S. Pat. No. 3,577,574, could be preformed in the transverse wires of the grid and used in place of the sheet metal clips 42.

Therefore, I do not intend to be limited, except by the scope of the following appended claims.

Having described my invention, I claim:

1. A collapsible bedding foundation comprising rectangular base frame and a rectangular top wire grid, said top wire grid being movable between a first collapsed position in which said wire grid resides in close adjacency to said base frame and a second erect position in which said wire grid is spaced further from said base frame, said base frame having first opposed longitudinal end edges and second opposed lateral side edges, said wire grid having first opposed longitudinal end edges and second opposed lateral side edges of approximately the same longitudinal and lateral dimensions as said base frame, a first plurality of spaced, parallel, substantially planar support elements extending between said base frame and said wire grid, said support elements extending between one of said first and second opposed edges, means pivotally securing each of said first plurality of support elements to said base frame and to said wire grid, and securement means for securing and maintaining said foundation in an erect position, said securement means consisting solely of a second plurality of spaced, parallel, substantially planar support elements extending between said base frame and said wire grid, each of said second plurality of support elements extending between the other of said first and second opposed edges and being perpendicular to said first plurality of support elements, means pivotally securing said second plurality of support elements to one of said base frame and wire grid, said second plurality of support elements being movable between a generally horizontal position when said foundation is in a collapsed condition and a generally vertical position when said foundation is erected, said second plurality of support elements being adapted to be fixedly secured to said other of said base frame and wire grid to maintain said foundation in an erect position, and said second plurality of support elements comprising a pair of support elements, each of said pair of support elements extending between one edge of said wire grid and a corresponding edge of said base frame.

2. The foundation of claim 1 wherein said first plurality of support elements extend between said lateral side edges of said foundation and said second plurality of support elements extend between said longitudinal end edges of said foundation.

3. The foundation of claim 1 wherein each of said first plurality of support elements comprises a single unitary wire having multiple sections extending between said base frame and said wire grid.

4. The foundation of claim 1 or 3 wherein each of said second plurality of support elements comprises a single unitary wire having multiple sections extending between said base frame and said wire grid when said foundation is erected.

5. A collapsible bedding foundation comprising a rectangular base frame and a rectangular top wire grid, said top wire grid being movable between a first collapsed position in which said wire grid resides in close adjacency to said base frame and a second erect position in which said wire grid is spaced further from said base frame, said base frame having first opposed longitudinal end edges and second opposed lateral side edges, said wire grid having first opposed longitudinal end edges and second opposed lateral side edges of approximately the same longitudinal and lateral dimensions as said base frame, a first plurality of spaced, parallel, substantially planar support elements extending between said base frame and said wire grid, said support elements extending between one of said first and second opposed edges, means pivotally securing each of said first plurality of support elements to said base frame and to said wire grid, and securement means for securing and maintaining said foundation in an erect position, said securement means consisting solely of a second plurality of spaced, parallel, substantially planar support elements extending between said base frame and said wire grid, each of said second plurality of support elements being perpendicular to said first plurality of support elements, means pivotally securing said second plurality of support elements to one of said base frame and wire grid, said second plurality of support elements being movable between a generally horizontal position when said foundation is in a collapsed condition and a generally vertical position when said foundation is erected, said second plurality of support elements being adapted to be fixedly secured to said other of said base frame and wire grid to maintain said foundation in an erect position, and said second plurality of support elements comprising a pair of support elements, each of said pair of support elements extending between one edge of said wire grid and a corresponding edge of said base frame.

6. The foundation of claim 5 wherein said first plurality of support elements extend between said lateral side edges of said foundation and said second plurality of support elements extend between said longitudinal end edges of said foundation.

7. The foundation of claim 5 wherein each of said first plurality of support elements comprises a single unitary wire having multiple sections extending between said base frame and said wire grid.

8. The foundation of claim 5 or 7 wherein each of said second plurality of support elements comprises a single unitary wire having multiple sections extending between said base frame and said wire grid when said foundation is erected.

9. The foundation of claims 1 or 5 wherein each of said support elements comprises a single unitary wire having at least two overlapped sinusoidal sections interconnected at the ends by an offset section.

10. The foundation of claim 9 wherein each of said sinusoidal sections extends through approximately 330 sinusoidal degrees.

11. The foundation of claim 10 wherein each of said offset sections is a section of straight wire.

12. A spring for use in a bedding foundation for interconnecting a base frame to a top wire grid, which spring comprises a single wire formed into a planar configuration, said wire having multiple overlapped sinusoidal sections interconnected by offset sections, said sinusoidal sections extending for approximately 330 sinusoidal degrees.

13. The spring of claim 12 wherein each of said offset sections is a straight section of wire which interconnects adjacent ends of said multiple overlapped sinusoidal sections.

* * * * *